US007766763B2

(12) United States Patent
Sorenson

(10) Patent No.: US 7,766,763 B2
(45) **Date of Patent: *Aug. 3, 2010**

(54) PUTTING TRACK

(75) Inventor: James W. Sorenson, Evergreen, CO (US)

(73) Assignee: Momentus Golf, Mount Pleasant, IA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/274,563

(22) Filed: Nov. 20, 2008

(65) Prior Publication Data

US 2009/0286614 A1 Nov. 19, 2009

Related U.S. Application Data

(63) Continuation-in-part of application No. 12/120,609, filed on May 14, 2008, now Pat. No. 7,666,107.

(51) Int. Cl.
*A63B 69/36* (2006.01)

(52) U.S. Cl. ..... 473/256; 473/226

(58) Field of Classification Search ..... 473/218, 473/219, 257–266, 231
See application file for complete search history.

(56) References Cited

U.S. PATENT DOCUMENTS

| | | | | |
|---|---|---|---|---|
| 1,409,688 | A | 3/1922 | Edgar | |
| 3,194,565 | A | 7/1965 | Schroer | |
| 3,953,035 | A | 4/1976 | Beckisk | |
| 5,332,211 | A | 7/1994 | Rife et al. | |
| 5,346,220 | A | 9/1994 | Cooper et al. | |
| 5,435,547 | A * | 7/1995 | Lee | 473/225 |
| 5,527,037 | A | 6/1996 | Matsumoto | |
| 6,273,826 | B1 | 8/2001 | Bauer | |
| 6,561,920 | B1 | 5/2003 | Hamilton | |
| 6,746,339 | B1 | 6/2004 | Thibaudeau | |
| 6,929,561 | B2 | 8/2005 | Chang | |
| 7,025,689 | B2 | 4/2006 | Infalt | |
| 7,217,198 | B2 | 5/2007 | Brooks | |
| 2002/0016213 | A1 * | 2/2002 | Templeton | 473/257 |

(Continued)

FOREIGN PATENT DOCUMENTS

GB 2199754 A 7/1988

(Continued)

OTHER PUBLICATIONS

"U.S. Appl. No. 12/120,609, Restriction Requirement mailed Apr. 14, 2009", 4 pgs.

(Continued)

*Primary Examiner*—Nini Legesse
(74) *Attorney, Agent, or Firm*—Schwegman, Lundberg & Woessner, P.A.

(57) ABSTRACT

A golf stroke training device includes a base that has a first section and a second section, and a vertical guide coupled to the base. The vertical guide is substantially perpendicular to the base. The first section has an arc extending from an approximate midpoint of the device to a first end of the device, and the second section comprises a substantially straight edge extending from the approximate midpoint of the device to a second end of the device. In another embodiment, the second section comprises a substantially straight edge extending from the approximate midpoint towards the target and an inside along an arc.

18 Claims, 4 Drawing Sheets

U.S. PATENT DOCUMENTS

| | | | |
|---|---|---|---|
| 2002/0082106 | A1 | 6/2002 | Czaja |
| 2005/0159233 | A1 | 7/2005 | Piche |

FOREIGN PATENT DOCUMENTS

| | | | |
|---|---|---|---|
| GB | 2364922 | A | 2/2002 |
| WO | WO-9314832 | A1 | 8/1993 |

OTHER PUBLICATIONS

"U.S. Appl. No. 12/120,609, Final Office Action mailed Jul. 16, 2009", 8 pgs.

"U.S. Appl. No. 12/120,609, Response filed Jan. 22, 2009 to Non-Final Office Action mailed on Oct. 27, 2008", 16 pgs.

"U.S. Appl. No. 12/120,609, Response filed May 7, 2009 to Restriction Requirement mailed Apr. 14, 2009", 6 pgs.

"U.S. Appl. No. 12/120,609, Response filed Sep. 16, 2009 to Final Office Action mailed Jul. 16, 2009", 7 pgs.

"British Application Serial No. GB0908218.1, Search report and cited reference mailed Aug. 19, 2009", 4 pgs.

"U.S. Appl. No. 12/120,609 Non-Final Office Action mailed on Oct. 27, 2008", OARN, 3 Pgs.

* cited by examiner

PUTTING TRACK

RELATED APPLICATION

This application is a continuation in part of U.S. patent application Ser. No. 12/120,609 filed on May 14, 2008 now U.S. Pat. No. 7,666,107, the contents of which are incorporated by reference in their entirety.

TECHNICAL FIELD

Various embodiments relate to golf training equipment, and in an embodiment, but not by way of limitation, a golf stroke training device.

BACKGROUND

Golfers are always trying to improve their putting, as evidenced by new putter designs that come onto the market on a regular basis, and the many different putters a typical golfer will try during a season or a lifetime. However, despite the multitude of putters and other devices available, the art is still in need of a device that will increase the putting proficiency of a golfer.

DETAILED DESCRIPTION

Figure 1:
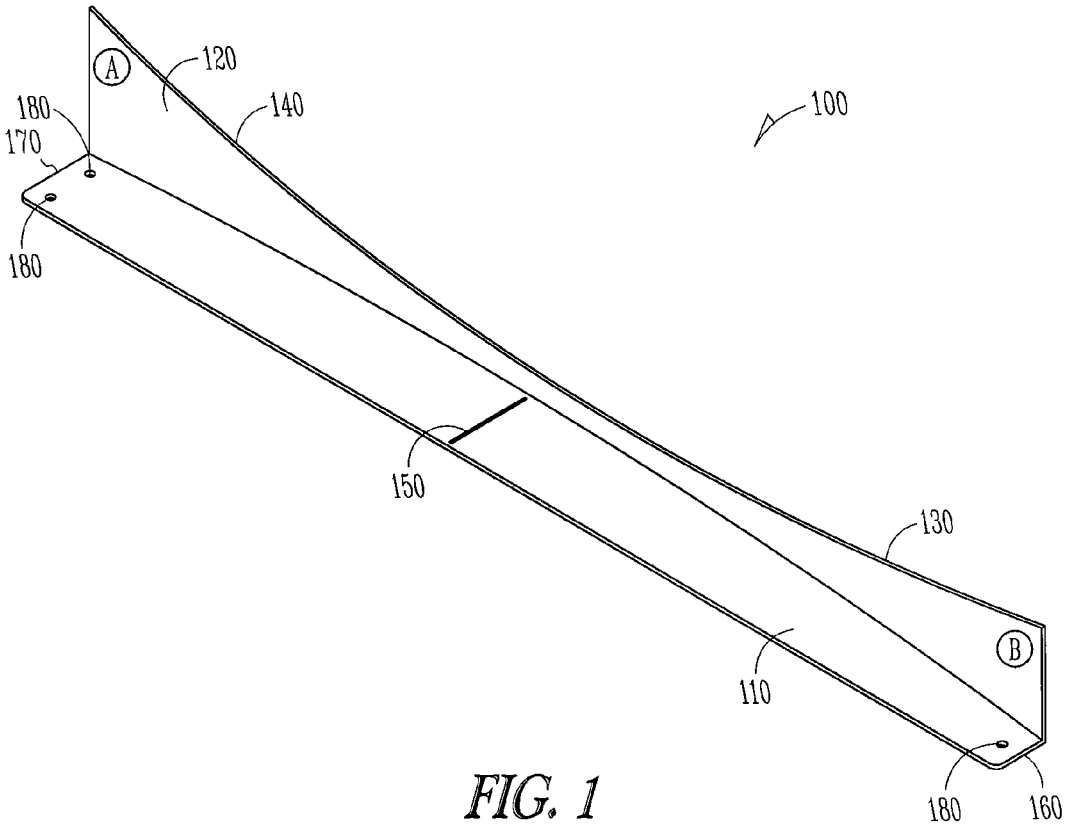
FIG. 1 is a perspective view of an example embodiment of a golf stroke training device.

In the following detailed description, reference is made to the accompanying drawings that show, by way of illustration, specific embodiments in which the invention may be practiced. These embodiments are described in sufficient detail to enable those skilled in the art to practice the invention. It is to be understood that the various embodiments of the invention, although different, are not necessarily mutually exclusive. Furthermore, a particular feature, structure, or characteristic described herein in connection with one embodiment may be implemented within other embodiments without departing from the scope of the invention. In addition, it is to be understood that the location or arrangement of individual elements within each disclosed embodiment may be modified without departing from the scope of the invention. The following detailed description is, therefore, not to be taken in a limiting sense, and the scope of the present invention is defined only by the appended claims, appropriately interpreted, along with the full range of equivalents to which the claims are entitled. In the drawings, like numerals refer to the same or similar functionality throughout the several views.

In a golf swing, including a putting stroke, there is an address position, a back stroke, and a through stroke. The address position is when the club is at rest, at an approximate center point of a golfer's stance. The back stroke is the portion of the golf stroke when a golfer moves the club from the address point back towards the right hand side of a right handed golfer, or the left hand side of a left handed golfer. The through stroke is the portion of the swing from the furthest point of the back stroke, through the address point, and forward towards the left hand side of a right handed golfer and the right hand side of a left handed golfer. An inside along an arc stroke path refers to either a back stroke or a through stroke which is taken back or forward along an arc that curves in towards a golfer's body.

There are many theories on putting methods and techniques. One theory is that a golfer should take a putter straight back in the back stroke, and then follow straight through towards the target in the through stroke. This theory, when put into practice, results in the putter head following a straight line that is substantially in line with a target throughout the stroke. Another technique uses an inside along an arc in the back stroke, and an inside along an arc in the through stroke. The path that the putter head travels in this instance is roughly an arc. Many consider this the most natural putting stroke, perhaps because it is similar to the arc that a golfer makes in a full golf swing.

The inventor of the present subject matter has developed new putting strokes, and apparatuses to assist a golfer in learning, practicing, and perfecting these new putting strokes. The new putting strokes include an inside along an arc back stroke and a straight down the line towards the target through stroke, and an inside along an arc back stroke, a straight down the line towards the target for a first portion of the through stroke, and an inside along an arc for a second portion of the through stroke.

Figure 2:
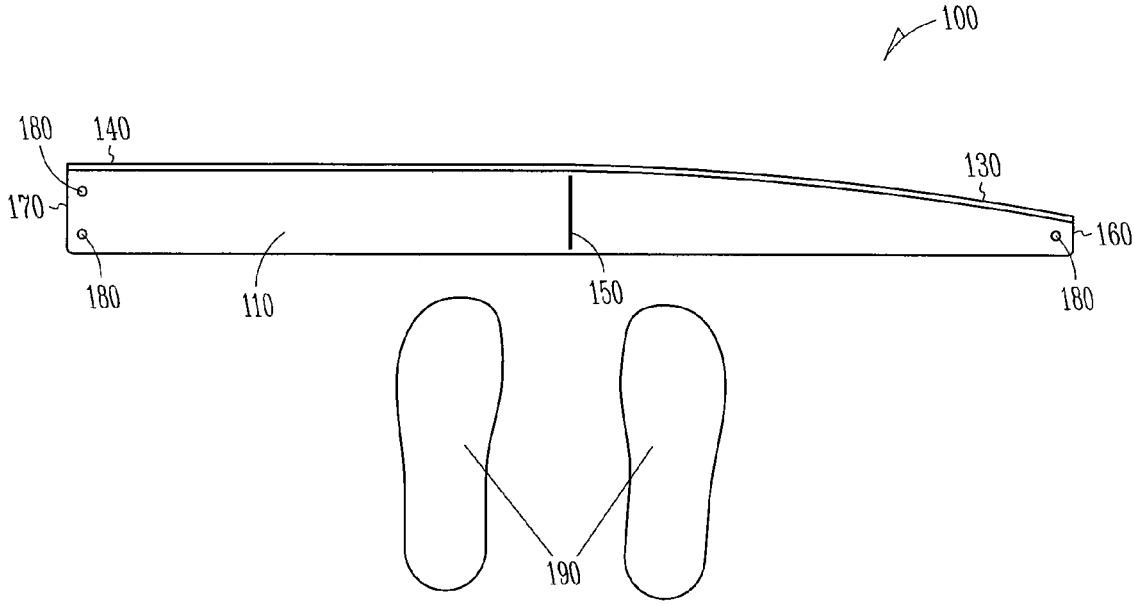
FIG. 2 is a top planar view of an example embodiment of a golf stroke training device.
Figure 4:
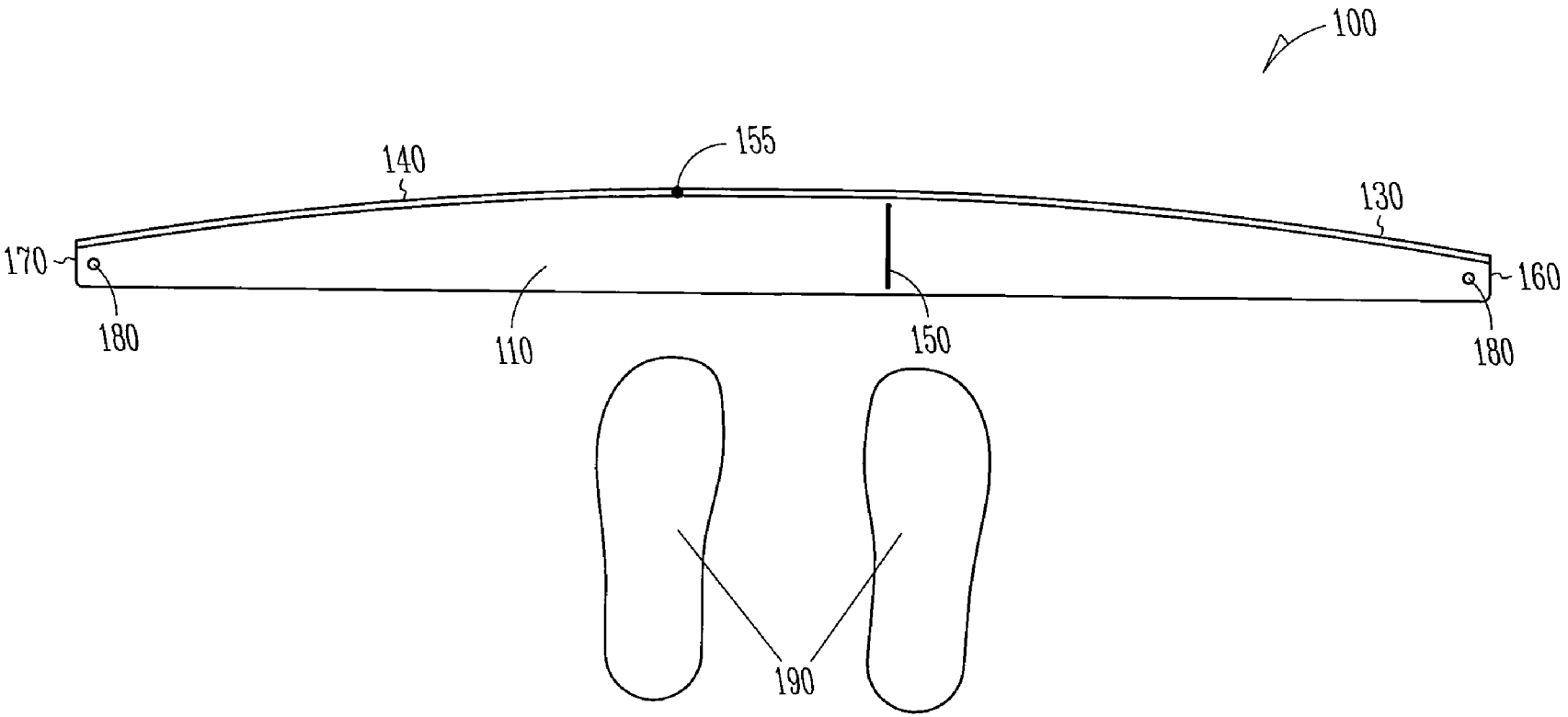
FIG. 4 is a top planar view of an example embodiment of a golf stroke training device.

FIGS. 1, 2, and 4 illustrate example embodiments of a golf stroke training device. The device 100 includes a base 110 and a vertical guide 120. The vertical guide 120 is substantially perpendicular to the base 110. The base 110 and vertical guide 120 can be of unitary construction. The base 110 and vertical guide 120 can also be separate pieces coupled together by fasteners, welds, solders, or any means of attachment known in the art. The device 100 includes a first section 130, and a second section 140. The first section 130, when viewed from the top as illustrated in FIG. 2, forms an arc that extends from an approximate midpoint 150 of the device 100 to an endpoint 160 of the device 100. The second section 140, when viewed from the top as illustrated in FIG. 2, forms a substantially straight edge that extends from the approximate midpoint 150 to a second endpoint 170 of the device 100. In another embodiment, as illustrated in FIG. 4, the second section 140, when viewed from the top, forms a substantially straight edge that extends from the approximate midpoint 150 to a point 155 along the second section 140, and then from the point 155 to the second endpoint 170, the section 140 follows an inside along an arc line. The length of the section from the approximate midpoint 150 to the point 155 can vary from as little as a couple of centimeters to 30 centimeters or more. When viewed from a side or a perspective view as illustrated in FIG. 1, it can be seen the that height of the vertical guide 120 at the approximate midpoint 150 is at a minimum, the height of the vertical guide 120 is greater at the endpoint 160 of section 130, and the height of the vertical guide 120 is at a maximum at the endpoint 170 of section 140. In another embodiment, the height of the vertical guide 120 is at a maximum at the endpoint 160. Varying the height of the vertical guide 120 along its length affects the putting stroke as described later herein. The base 110 includes holes 180 for receiving fasteners that can attach the device 100 to a surface. The device 100 can be attached to any surface, including a backyard, a floor in a family room, or a putting green.

In a particular use of the device 100, the arc extending from the approximate midpoint 150 to the endpoint 160 (when viewed from the top as in FIG. 2) represents an inside along an arc putting back stroke wherein a golfer draws a putter back and towards himself thereby forming an arc. The straight line from the approximate midpoint 150 to the second endpoint 170 (as further illustrated in FIG. 2) represents a straight follow through towards the target in the through stroke of a putting stroke. The height of the vertical guide 120 represents the vertical path of the club head in the novel inside along an arc back stroke and the straight line of the through stroke, and the vertical guide 120 guides the club head through this path.

In another use of the device 100, the arc extending from the approximate midpoint 150 to the endpoint 160 (when viewed from the top as in FIG. 4) represents an inside along an arc putting back stroke wherein a golfer draws a putter back and towards himself thereby forming an arc. The straight line from the approximate midpoint 150 to the point 155 (as further illustrated in FIG. 4) represents a straight follow through towards the target in a first portion of the through stroke of a putting stroke. Then, after passing the point 155, the device 100 guides a golfer's putting stroke along an inside along an arc path to the second endpoint 170. The height of the vertical guide 120 represents and guides the vertical path of the club head in the novel inside along an arc back stroke, the straight line of a first portion of the through stroke, and an inside along the arc second portion of the through stroke.

The device 100 can be used in connection with training a golfer to execute a proper golf stroke, and in particular, a proper putting stroke. For example, to use the device 100 to train a golfer's putting stroke, the device 100 can be attached to a putting green, one's living room floor, or any other suitable surface. When a typical putting surface is used, any simple type fasteners, including golf tees, can be inserted through the holes 180 in the base 110 of the device 100, and into the putting surface. After securing the device 100 to the putting surface, a golfer stands on the base side of the device as shown by the outline of the feet 190 in FIGS. 2 and 4. The golfer grips a putter, and places it into the address position wherein the heel of the putter is in contact with the vertical guide 120 at the approximate midpoint 150. Then, with or without a ball to strike, the golfer draws the club back so that the heel of the putter remains in contact with the first section 130, and after reaching the farthest point of the back stroke, moves the putter head forward to return the putter head to the approximate midpoint 150, through the straight edge section 140, and to the second endpoint 170. In the embodiment of FIG. 4, the golfer once again grips a putter, and places it into the address position wherein the heel of the putter is in contact with the vertical guide 120 at the approximate midpoint 150. Then, with or without a ball to strike, the golfer draws the club back so that the heel of the putter remains in contact with the first section 130, and after reaching the furthest point of the back stroke, moves the putter head forward to return the putter head to the approximate midpoint 150, through the straight edge section 140 to the point 155 in the section 140, and then from the point 155 along the inside arc to the second endpoint 170. By keeping the heel of the club in contact with the first section, a golfer learns an inside along an arc back stroke. By keeping the heel in contact with the second section 140, a straight line towards the target through stroke is learned. In the embodiment of FIG. 4, a straight line towards the target followed by an inside along an arc through stroke is learned. These putting strokes result in straighter more accurate putts.

The height of the vertical guide 120 at the approximate midpoint 150, at the endpoint 160 of the section 130, and at the endpoint 170 of the section 140, trains a golfer to follow the vertical path of the new putting strokes. The vertical path of the new putting strokes starts out low at the address of the ball (approximate midpoint 150), rises along the inside arc during the back stroke up to point B in FIG. 1, returns down along the inside arc to the approximate midpoint 150, and gradually rises up along the inside arc in the through stroke to the point A at endpoint 170 of section 140. As noted above, the heights of the vertical guide 120 at the endpoints 160 and 170 can vary, which can be used to alter the putting stroke to suit the particular needs of each golfer.

Figure 3:
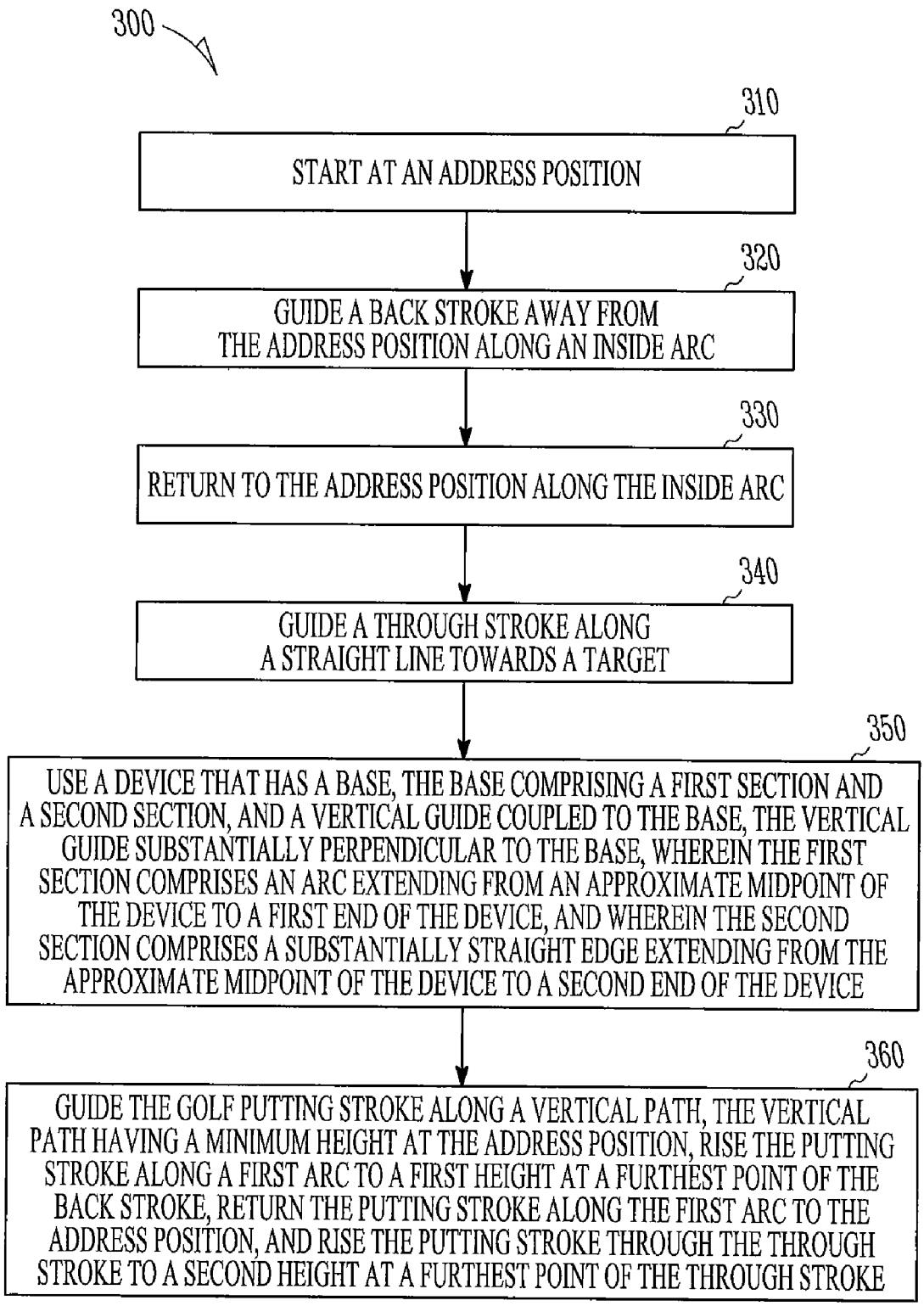
FIG. 3 is a flowchart of a method for a golf putting stroke.
Figure 5:
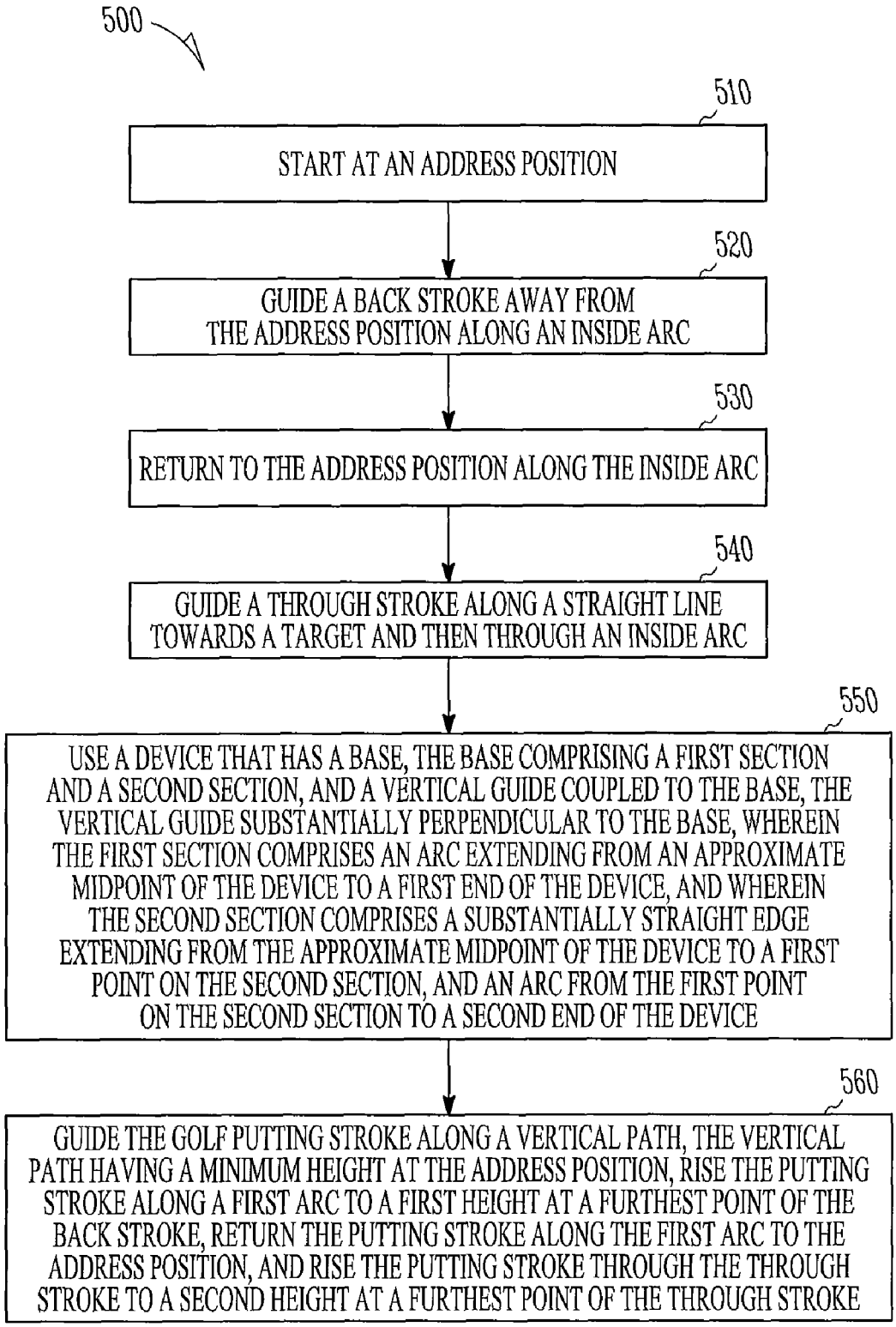
FIG. 5 is a flowchart of a method for a golf putting stroke.

FIGS. 3 and 5 are flowcharts illustrating the steps in these methods of golf putting strokes.

The device 100 can be used with virtually any style putter including standard length putters, belly putters, and long putters; blade putters, mallet putters, and Anser-like putters; and many putter faces including steel, polymer insert, grooves, and bumps. The device 100 can be used irrespective of the particular putting grip of a golfer including overlap, reverse overlap, cross hand, and claw grips.

Example Embodiments

In Example 1, a golf stroke training device includes a base, the base comprising a first section and a second section; and a vertical guide coupled to the base. The vertical guide is substantially perpendicular to the base. The first section comprises a first arc, and the second section comprises a substantially straight edge and a second arc.

In Example 2, the golf stroke training device of Example 1 optionally includes a vertical guide with a minimum height at an approximate midpoint of the base, a greater height at a first end of the device and the second end of the device than at the approximate midpoint of the device, and a substantially continuous arc formed by the vertical guide extending from the first end of the device through the approximate midpoint to the second end of the device.

In Example 3, the golf stroke training device of Examples 1-2 optionally includes a device wherein the height of the vertical guide at the first end of the device is greater than the height of the vertical guide at the second end of the device.

In Example 4, the golf stroke training device of Examples 1-3 optionally includes a device wherein the height of the vertical guide at the second end of the device is greater than the height of the vertical guide at the first end of the device.

In Example 5, the golf stroke training device of Examples 1-4 optionally includes a device wherein the minimum height is approximately 3 cm, the height at the first end point is approximately 10 cm, and the height at the second end point is approximately 14 cm.

In Example 6, the golf stroke training device of Examples 1-5 optionally includes a device including a plurality of holes in the base, the plurality of holes for receiving one or more fastening devices for securing the training device to a surface.

In Example 7, the golf stroke training device of Examples 1-6 optionally includes a device wherein the vertical guide is coupled to the base along an edge of the base on a side of the base comprising the first arc and the second arc.

In Example 8, the golf stroke training device of Examples 1-7 optionally includes a device wherein the first section correlates to a position of a putting stroke addressing a golf ball to a point of a back stroke of the putting stroke.

In Example 9, the golf stroke training device of Examples 1-8 optionally includes a device wherein the second section correlates to a position of a putting stroke addressing a golf ball to a point of a through stroke of the putting stroke.

In Example 10, the golf stroke training device of Examples 1-9 optionally includes a device wherein the vertical guide is configured to receive and guide a heel of a putter head along a desired path.

In Example 11, the golf stroke training device of Examples 1-10 optionally includes a device wherein the first arc is formed by a base width of approximately 8 cm at an approximate midpoint of the base and a base width of approximately 3 cm at a first end of the device, and the second arc is formed by the base width of approximately 8 cm at the approximate midpoint of the base and a base width of approximately 3 cm at a second end of the device.

In Example 12, the golf stroke training device of Examples 1-11 optionally includes a device wherein the base is approximately 95 centimeters in length.

In Example 13, the golf stroke training device of Examples 1-12 optionally includes a device wherein the first arc is formed by a base width of approximately 7 cm at an approximate midpoint of the base and a base width of approximately 5 cm at a first end of the device, and the second arc is formed by the base width of approximately 7 cm at the approximate midpoint of the base and a base width of approximately 5 cm at a second end of the device.

In Example 14, the golf stroke training device of Examples 1-13 optionally includes a device wherein the base is approximately 60 centimeters in length.

In Example 15, a method to teach a golf putting stroke includes starting at an address position, guiding a back stroke away from the address position along a first inside arc, returning to the address position along the inside arc, and guiding a through stroke along a straight line towards a target and then along a second inside arc.

In Example 16, the method of Example 15 optionally includes using a device to teach the method of the golf putting stroke, the device comprising a base, the base comprising a first section and a second section; and a vertical guide coupled to the base, the vertical guide substantially perpendicular to the base; wherein the first section comprises an arc extending from an approximate midpoint of the device to a first end of the device; and wherein the second section comprises a substantially straight edge extending from the approximate midpoint of the device to a point on the second section, and comprises an inside along an arc from the point on the second section to a second end of the device.

In Example 17, the method of Examples 15-16 optionally includes guiding the golf putting stroke along a vertical path, the vertical path comprising a minimum height at the address position, rising along a first arc to a first height at a furthest point of the back stroke, returning along the first arc to the address position, and rising along a second arc through the through stroke to a second height at a furthest point of the through stroke.

In Example 18, the method of Examples 15-17 optionally includes a feature wherein the first height is greater than the second height.

In Example 19, the method of Examples 15-18 optionally includes a feature wherein the second height is greater than the first height.

In Example 20, a golf stroke training device includes a base, the base comprising a first section and a second section; and a vertical guide coupled to the base, the vertical guide substantially perpendicular to the base; wherein the first section comprises a first arc extending from an approximate midpoint of the device to a first end of the device; wherein the second section comprises a substantially straight edge extending from the approximate midpoint of the device to a point on the second section, and comprises an inside along an arc extending from the point on the second section to a second end of the device; wherein the vertical guide comprises a minimum height at the approximate midpoint, and the guide includes a greater height at the first end of the device and the second end of the device than at the approximate midpoint of the device; and wherein a substantially continuous arc is formed by the vertical guide extending from the first end of the device through the approximate midpoint to the second end of the device.

In Example 21, the golf stroke training device of Example 20 optionally includes a device wherein the first section extends from an approximate midpoint of the device to a first end of the device; and wherein the second section extends from the approximate midpoint of the device to a second end of the device.

In Example 22, the golf stroke training device of Examples 1-14 optionally includes a device wherein the first section extends from an approximate midpoint of the device to a first end of the device; and wherein the second section extends from the approximate midpoint of the device to a second end of the device.

In Example 23, the golf stroke training device of Examples 1-14 optionally includes a device wherein the substantially straight edge comprises a length in the range of approximately 2 centimeters to approximately 30 centimeters.

The Abstract is provided to comply with 37 C.F.R. §1.72(b) and will allow the reader to quickly ascertain the nature and gist of the technical disclosure. It is submitted with the understanding that it will not be used to interpret or limit the scope or meaning of the claims.

In the foregoing description of the embodiments, various features are grouped together in a single embodiment for the purpose of streamlining the disclosure. This method of disclosure is not to be interpreted as reflecting that the claimed embodiments have more features than are expressly recited in each claim. Rather, as the following claims reflect, inventive subject matter lies in less than all features of a single disclosed embodiment. Thus the following claims are hereby incorporated into the Detailed Description, with each claim standing on its own as a separate example embodiment.

The invention claimed is:

1. A golf stroke training device comprising:

a base, the base comprising a first section and a second section, the base further comprising an edge extending from an outer end of the first section, through a portion connecting the first section and the second section, to an outer end of the second section; and a vertical guide comprising a bottom edge, the bottom edge coupled to the base along an entire length of the edge of the base, the vertical guide perpendicular to the base;

wherein the first section comprises a first arc along the edge of the base;

wherein the second section comprises a straight edge adjoining the first arc of the first section at the portion connecting the first section and the second section and the second section comprises a second arc adjoining the straight edge at an end of the straight edge opposite the portion connecting the first section and the second section;

wherein the vertical guide comprises a minimum height at an approximate midpoint, and the vertical guide comprises a greater height at a first end of the device and a second end of the device than at the approximate midpoint of the device, and wherein a substantially continuous arc is formed by the vertical guide extending from the first end of the device through the approximate midpoint to the second end of the device; and wherein the vertical guide coupled to the first section and the second section of the base forms a continuous path for a reception and guidance of a heel of a golf putter head during a golf putting stroke.

2. The golf stroke training device of claim 1, wherein the height of the vertical guide at the first end of the device is greater than the height of the vertical guide at the second end of the device.

3. The golf stroke training device of claim 1, wherein the minimum height is approximately 3 cm, the height at the first end of the device is approximately 10 cm, and the height at the second end of the device is approximately 14 cm.

4. The golf stroke training device of claim 1, comprising a plurality of holes in the base, the plurality of holes for receiving one or more fastening devices for securing the training device to a surface.

5. The golf stroke training device of claim 1, wherein the vertical guide is coupled to the base along an edge of the base on a side of the base comprising the first arc and the second arc.

6. The golf stroke training device of claim 1, wherein the first section correlates to a position of a putting stroke addressing a golf ball to a point of a back stroke of the putting stroke.

7. The golf stroke training device of claim 1, wherein the second section correlates to a position of a putting stroke addressing a golf ball to a point of a through stroke of the putting stroke.

8. The golf stroke training device of claim 1, wherein the first arc is formed by a base width of approximately 8 cm at an approximate midpoint of the base, and a base width of approximately 3 cm at a first end of the device; and the second arc is formed by the base width of approximately 8 cm at the approximate midpoint of the base, and a base width of approximately 3 cm at a second end of the device.

9. The golf stroke training device of claim 8, wherein the base is approximately 95 centimeters in length.

10. The golf stroke training device of claim 1, wherein the first arc is formed by a base width of approximately 7 cm at an approximate midpoint of the base, and a base width of approximately 5 cm at a first end of the device; and the second arc is formed by the base width of approximately 7 cm at the approximate midpoint of the base, and a base width of approximately 5 cm at a second end of the device.

11. The golf stroke training device of claim 10, wherein the base is approximately 60 centimeters in length.

12. The golf stroke training device of claim 1, wherein the first section extends from an approximate midpoint of the device to a first end of the device; and wherein the second section extends from the approximate midpoint of the device to a second end of the device.

13. The golf stroke training device of claim 1, wherein the straight edge comprises a length in the range of approximately 2 centimeters to approximately 30 centimeters.

14. A method to teach a golf putting stroke comprising:

starting at an address position;

guiding a back stroke away from the address position along a first inside arc;

returning to the address position along the inside arc;

guiding a through stroke along a straight line towards a target and then guiding the through stroke along a second inside arc; and;

guiding the golf putting stroke along a vertical path, the vertical path comprising a minimum height at the address position, rising along a first arc to a first height at a furthest point of the back stroke, returning along the first arc to the address position, and rising along a second arc through the through stroke to a second height at a furthest point of the through stroke; and further comprising using a device to teach the method, the device comprising:

a base, the base comprising a first section and a second section, the base further comprising an edge extending from an outer end of the first section, through a portion connecting the first section and the second section, to an outer end of the second section; and a vertical guide comprising a bottom edge, the bottom edge coupled to the base along an entire length of the edge of the base, the vertical guide perpendicular to the base;

wherein the first section comprises a first arc along the edge of the base;

wherein the second section comprises a straight edge adjoining the first arc of the first section at the portion connecting the first section and the second section and the second section comprises a second arc adjoining the straight edge at an end of the straight edge opposite the portion connecting the first section and the second section;

wherein the vertical guide comprises a minimum height at an approximate midpoint, and the vertical guide comprises a greater height at a first end of the device and a second end of the device than at the approximate midpoint of the device, and wherein a substantially continuous arc is formed by the vertical guide extending from the first end of the device through the approximate midpoint to the second end of the device; and wherein the vertical guide coupled to the first section and the second section of the base forms a continuous path for a reception and guidance of a heel of a golf putter head during a golf putting stroke.

15. The method of claim 14, wherein the first height is greater than the second height.

16. The method of claim 14, wherein the second height is greater than the first height.

17. A golf stroke training device comprising:

a base, the base comprising a first section and a second section, the base further comprising an edge extending from an outer end of the first section, through a portion connecting the first section and the second section, to an outer end of the second section; and a vertical guide comprising a bottom edge, the bottom edge coupled to the base along an entire length of the edge of the base, the vertical guide perpendicular to the base;

wherein the first section comprises a first arc along the edge of the base;

wherein the second section comprises a straight edge adjoining the first arc of the first section at the portion connecting the first section and the second section and the second section comprises a second arc adjoining the straight edge at an end of the straight edge opposite the portion connecting the first section and the second section;

wherein the vertical guide comprises a minimum height at a point between the first section and the second section; and wherein a substantially continuous arc is formed by the vertical guide extending from the first section through to the second section.

18. The golf stroke training device of claim 17, wherein the first section extends from an approximate midpoint of the device to a first end of the device; and wherein the second section extends from the approximate midpoint of the device to a second end of the device.

* * * * *